US007363736B2

(12) United States Patent
Liu

(10) Patent No.: US 7,363,736 B2
(45) Date of Patent: Apr. 29, 2008

(54) ORNAMENTAL WATER BALL HAVING CONTINUOUS ANIMATION VISUAL EFFECT

(76) Inventor: Jack Liu, 3F., 200, Xin-Yi Rd., Sec. 3, Taipei (TW) 106

( * ) Notice: Subject to any disclaimer, the term of this patent is extended or adjusted under 35 U.S.C. 154(b) by 105 days.

(21) Appl. No.: 11/316,884

(22) Filed: Dec. 27, 2005

(65) Prior Publication Data

US 2007/0193084 A1 Aug. 23, 2007

(51) Int. Cl.
*G09F 19/00* (2006.01)

(52) U.S. Cl. ..... 40/406; 40/427; 40/430

(58) Field of Classification Search ..... 40/406, 40/409, 410, 427, 430, 219; 428/13, 14
See application file for complete search history.

(56) References Cited

U.S. PATENT DOCUMENTS 4,307,528 A * 12/1981 Dewees et al. ..... 40/433
5,272,604 A * 12/1993 Lin ..... 40/406
6,334,271 B1 * 1/2002 Su Yeh ..... 40/430
7,003,906 B1 * 2/2006 Yang ..... 40/430
2002/0152654 A1 * 10/2002 Liao ..... 40/406
2003/0014889 A1 * 1/2003 Zhao ..... 40/406

* cited by examiner

*Primary Examiner*—Gary C. Hoge

(57) ABSTRACT

A rotating base provided to exterior of an ornamental water ball or a table-top ornament and having continuous animation visual effect, including: a water ball or table-top ornament filled with liquid, a support for supporting the water ball or table-top ornament, and a conventional music unit or motor its transmission mechanism concealed in the base, wherein the rotating base in provided above the base and having therein a reflective lenses frame constructed of a plural rectangular lenses, and an adhesive sticker frame surrounding the reflective lenses frame and applied with plural animation adhesive stickers, in an amount equal to that of the lenses, at an inner side opposing the plural rectangular lenses are provided. As such, when the rotating base is driven to rotate by the conventional music unit or motor and its transmission mechanism, all of the adhesive stickers applied to an inner side of the adhesive sticker frame will be reflected by a corresponding rectangular lens so as to feature the water ball with continuous animation visual effect.

5 Claims, 2 Drawing Sheets

ORNAMENTAL WATER BALL HAVING CONTINUOUS ANIMATION VISUAL EFFECT

CROSS-REFERENCES TO RELATED APPLICATIONS

Not Applicable

STATEMENT REGARDING FEDERALLY SPONSORED RESEARCH OR DEVELOPMENT

Not Applicable

DESCRIPTION

1. Field of Invention

This invention relates to an improved water ball or table-top ornament structure, particularly to a rotating base provided to exterior of an ornamental water ball or a table-top ornament and having continuous animation visual effect.

2. Background

Conventional ornamental water balls (ornamental water balls) are constructed of the basic structure of a transparent water ball, in which is provided with theme models and decorative background such as tree, houses, castles or cartoon characters, in accompaniment with simulated snow flakes, to feature the water ball with dynamic viewing effect. The water ball base may alternatively be provided with a manual spring musical unit, to feature the water ball with visual as well as audio effect.

The emphasis for designing ornamental water balls in the industry mostly resides in the variety and attractiveness of the theme models, or the dynamic effect of the theme models within the water ball to earn the consumers' favor. The so-called dynamic landscape ornamental water balls (ornamental water balls with dynamic effect) refer to those having a variety of landscape models, which can be furnished on the tabletop or cupboard in a household or an office as an ornament object, wherein the landscape models may include tree, houses, castles or characters. To enhance the attractiveness of the landscape, the winding of a manual spring of a based musical unit to accumulate mechanical energy that is later released for driving rotation of the landscape models via a transmission mechanism may feature the water balls with rotating dynamic effect.

For example, the Chinese Model Patent No. 02238792.3 commonly assigned discloses a water ball provided therein with theme landscapes and filled with liquid. The base for supporting the water ball and liquid is provided therein with an agitating device, such as a transmission mechanism, for rotating and stirring the liquid and lighting with decorative effect. The mechanical energy accumulated by winding a manual spring is released to become power that is subsequently transmit upwards for driving rotation of the agitating device to continuously stir the water thereby causing palettes distributed in the liquid to flow around the water ball along with the liquid, to generate a simulated dynamic landscape effect of snowing in accompaniment with a lighting background.

As "dynamic landscape ornaments" target at providing ornamental and playful effects, it is thus an object for the industry to enhance their dynamic effect so as to feature the visual landscape with improve attractiveness, for earning consumers' favor.

SUMMARY OF INVENTION

According to an aspect of this invention, a rotating base provided to exterior of an ornamental water ball or a table-top ornament and having continuous animation visual effect is provided, the wall ball includes a water ball or table-top ornament filled with liquid, a support for supporting the water ball or table-top ornament, and a conventional music unit or motor its transmission mechanism concealed in the base, wherein the rotating base in provided above the base and having therein a reflective lenses frame constructed of a plural rectangular lenses, and an adhesive sticker frame surrounding the reflective lenses frame and applied with plural animation adhesive stickers, in an amount equal to that of the lenses, at an inner side opposing the plural rectangular lenses are provided. As such, when the rotating base is driven to rotate by the conventional music unit or motor and its transmission mechanism, all of the adhesive stickers applied to an inner side of the adhesive sticker frame will be reflected by a corresponding rectangular lens so as to feature the water ball with continuous animation visual effect.

BRIEF DESCRIPTION OF THE DRAWINGS

These and other modifications and advantages will become even more apparent from the following detailed description of a preferred embodiment of the invention and from the drawings in which.

DETAILED DESCRIPTION OF THE INVENTION (PREFERRED EMBODIMENTS)

Figure 1:
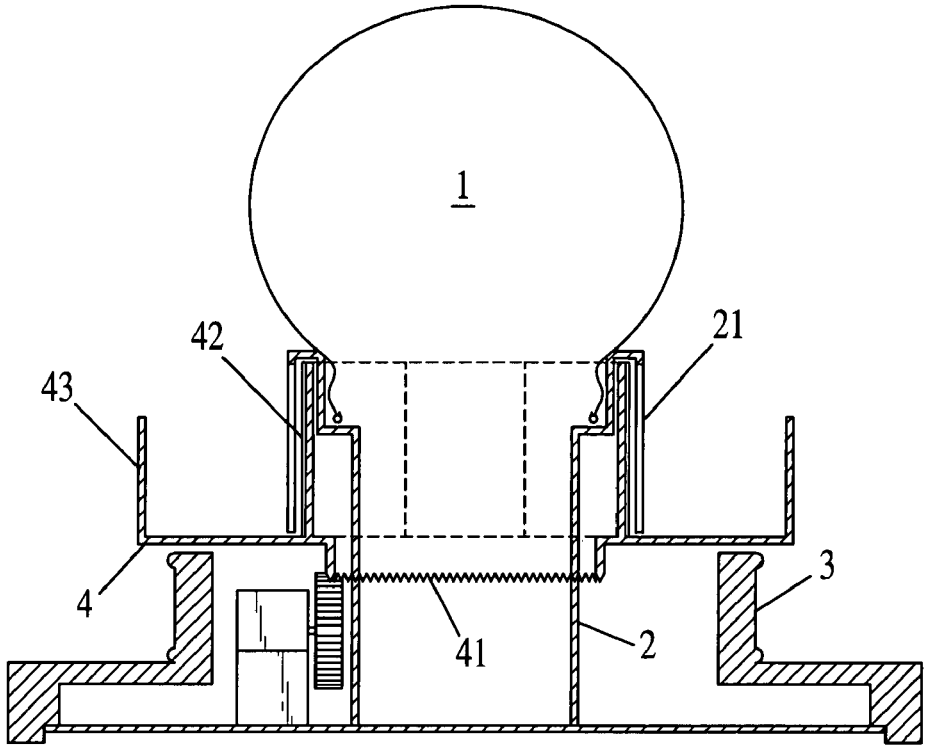
FIG. 1 illustrates an embodiment of the invention.
Figure 2:
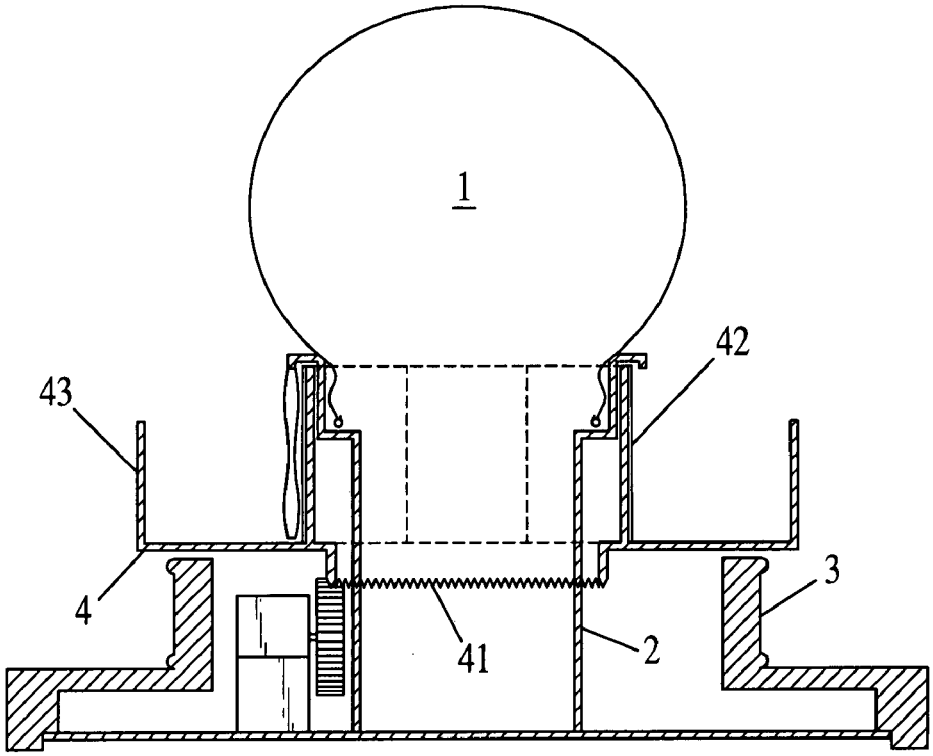
FIG. 2 illustrates another embodiment of the invention.

With reference to FIG. 1, an embodiment of this invention includes a water ball or table-top ornament 1 (shown as a water ball in the drawing) filled with liquid, a support 2 for supporting the water ball or table-top ornament, a conventional music unit or motor and its transmission mechanism (not shown) provided on the rotating base 4 and concealed in the base 3.

In the prior art mentioned above, the prior water ball uses power provided by a conventional music unit or motor to drive simultaneous rotation of the water ball and ornamental models in the water ball by manes of a transmission mechanism. Similarly, the same form of power transmission may be implemented in this invention, where the power provided by the musical unit or motor in the base 3 is used to drive rotation of the rotating base 4 provided to an exterior of the water ball or table-top ornament 1 by means of the transmission mechanism. That is, a driven gear 41 provided beneath the rotating base 4, that is located above base 3, may be driven by the power generated by the conventional music unit or motor around the exterior of the water ball or table-top ornament 1.

The rotating base 4 includes a reflective lenses frame 42 provided at a inner end and an adhesive sticker frame 43 surrounding the reflective lenses frame 42 and corresponding the reflective lenses frame 42, wherein the reflective lenses frame 42 includes plural rectangular lenses that are arranged in an order to form a polygonal frame, and the adhesive sticker frame 43 is applied with plural animation adhesive stickers, in an amount equal to that of the lenses, at an inner side opposing the plural rectangular lenses are provided.

In this embodiment, the support 2 for supporting the water ball 1 is formed with an outwardly and downwardly extending viewing window 21 situated at an outside and in parallel with the reflective lenses frame 42. The viewing window 21 does not obstruct the outwards reflection function of the lenses, but covering part of the rectangular lenses to enhance their visual aesthetic effect. However, the viewing window 21 is optional; that is, the reflective lenses frame 42 may also be completely exposed. Alternatively, the outwardly and downwardly extending viewing window 21 of the support 2 of the water ball 1 may be replaced with decorative sculptures occupying the same space.

When the driven gear 41 provided beneath rotating base 4 is driven to rotate about the exterior of water ball or table-top ornament 1 by means of the power generated by the conventional music unit or motor and its transmission mechanism, all of the animation adhesive sticker applied to an inner side of the of the adhesive sticker frame 43 will be reflected by a corresponding rectangular lens of the reflective lenses frame 42 so as to feature the water ball with continuous animation visual effect.

In sum, through a simple structure, this invention provides a reflective lenses frame constructed of a plural rectangular lenses, and an adhesive sticker frame surrounding the reflective lenses frame and applied with plural animation adhesive stickers, in an amount equal to that of the lenses, at an inner side opposing the plural rectangular lenses are provided. As such, when the rotating base is driven to rotate by the conventional music unit or motor and its transmission mechanism, all of the adhesive stickers applied to an inner side of the adhesive sticker frame will be reflected by a corresponding rectangular lens so as to feature the water ball with continuous animation visual effect.

This invention is related to a novel creation that makes a breakthrough in the art. Aforementioned explanations, however, are directed to the description of preferred embodiments according to this invention. Since this invention is not limited to the specific details described in connection with the preferred embodiments, changes and implementations to certain features of the preferred embodiments without altering the overall basic function of the invention are contemplated within the scope of the appended claims.

LIST OF REFERENCE NUMERALS

1 water ball or table-top ornament
2 support
21 viewing window
3 base
4 rotating base
41 driven gear
42 reflective lenses frame
43 adhesive sticker frame

What is claimed is:

1. An ornamental water ball comprising: a water ball filled with liquid, a support for supporting the water ball, and a motor and its transmission mechanism concealed in the support, a rotating base mounted on the support, wherein the rotating base has therein a reflective lenses frame, and an adhesive sticker frame surrounding the reflective lenses frame, whereby when the rotating base is driven to rotate by the motor and its transmission mechanism, adhesive stickers applied to an inner side of the adhesive sticker frame will be reflected by the corresponding reflective lenses frame so as to provide the water ball with a continuous animation visual effect.

2. The ornamental water ball of claim 1, wherein the reflective lenses frame includes plural rectangular lenses that are arranged in an order to form a polygonal frame.

3. The ornamental water ball of claim 2, wherein the adhesive sticker frame is supplied with plural animation adhesive stickers, in a number equal to that of the lenses, at an inner side opposing the plural rectangular lenses.

4. The ornamental water ball of claim 1, further comprising: an outwardly and downwardly extending viewing window situated at an outside and in parallel with the reflective lenses frame, wherein the viewing window does not obstruct the outwards reflection function of the lenses, but covers part of the rectangular lenses to enhance their visual aesthetic effect.

5. The ornamental water ball of claim 4, wherein the viewing window is in a form of decorative sculptures.

* * * * *